United States Patent [19]

Butler

[11] Patent Number: 4,856,129

[45] Date of Patent: Aug. 15, 1989

[54] TILTABLE BED FRAME ASSEMBLY

[76] Inventor: Wilbur T. Butler, 4039 Spyglass Rd., Oklahoma City, Okla. 73120

[21] Appl. No.: 139,299

[22] Filed: Dec. 28, 1987

Related U.S. Application Data

[63] Continuation-in-part of Ser. No. 899,488, Aug. 22, 1986, Pat. No. 4,715,037.

[51] Int. Cl.[4] ..... A61G 7/00

[52] U.S. Cl. ..... 5/62; 5/509; 108/8

[58] Field of Search ..... 5/11, 62–65, 5/509; 108/8; 297/328

[56] References Cited

U.S. PATENT DOCUMENTS

| | | | |
|---|---|---|---|
| Re. 26,411 | 6/1968 | Alsobrook, Jr. | 5/62 |
| 77,001 | 4/1868 | Collender | 5/63 |
| 357,688 | 2/1887 | Poolman et al. | 5/64 X |
| 503,196 | 8/1893 | Cooke . | |
| 506,056 | 10/1893 | Millar . | |
| 638,755 | 1/1899 | Piper et al. | 5/63 X |
| 757,807 | 4/1904 | Hazard | 5/63 X |
| 948,120 | 2/1910 | Wilson et al. . | |
| 1,008,168 | 11/1911 | Markus | 5/184 |
| 1,043,517 | 11/1912 | Gavan . | |
| 1,191,772 | 7/1916 | Dickerson . | |
| 2,326,183 | 8/1943 | Urbank | 5/62 |
| 2,649,595 | 8/1953 | Lewin | 5/345 |
| 3,201,806 | 8/1965 | Hutt | 5/62 |
| 3,310,289 | 3/1967 | Burke | 5/64 X |
| 3,317,931 | 5/1967 | Benoit et al. | 5/63 X |
| 3,789,437 | 2/1974 | Garte | 5/62 |
| 4,208,753 | 6/1977 | Rios | 5/108 |
| 4,277,857 | 7/1981 | Svehaug | 5/62 |
| 4,494,259 | 1/1985 | Miller et al. | 5/63 X |

FOREIGN PATENT DOCUMENTS

| | | | |
|---|---|---|---|
| 293895 | 11/1967 | Australia | 5/62 |
| 1491274 | 10/1969 | Fed. Rep. of Germany . | |
| 541889 | 4/1956 | Italy . | |
| 207715 | 12/1923 | United Kingdom . | |
| 2039731 | 8/1980 | United Kingdom . | |

*Primary Examiner*—Gary L. Smith
*Assistant Examiner*—Michael F. Trettel
*Attorney, Agent, or Firm*—Bill D. McCarthy

[57] ABSTRACT

A tiltable bed frame assembly is provided which permits one to adjust the angular disposition of a mattress between a horizontally disposed position and an inclined position, while at the same time permitting one to utilize a conventional mattress, headboard and footboard of a bedroom suit. The tiltable bed frame assembly comprises a main frame and a mattress frame interconnected by a plurality of telescoping members and pivoting support members disposed between the main frame and the mattress frame. The telescoping members are connected by a linkage assembly so that the mattress frame can be pivotally moved between the horizontally disposed position and the inclined position. A locking assembly is supported by the main frame for selectively engaging the linkage assembly and thereby securing the mattress frame in the desired position relative to the main frame. In one embodiment, the tiltable bed frame assembly comprises an elevating assembly for pivoting the mattress frame to the selected angular disposition. The elevating assembly includes a track member, a first support member having a lower end and an opposed upper end, and a power assembly. The lower end of the first support member is slideably supported by the track member and the opposed upper end is pivotably attached to the mattress frame near one end thereof. The power assembly selectively moves the lower end of the first support member along the track member so that the end of the mattress frame is elevated to pivot the mattress frame on the main frame in response to movement of the first support member.

13 Claims, 6 Drawing Sheets

TILTABLE BED FRAME ASSEMBLY

CROSS-REFERENCE TO RELATED APPLICATION

This application is a continuation-in-part of patent application, U.S. Ser. No. 899,488, entitled TILTABLE BED FRAME ASSEMBLY, filed Aug. 22, 1986, now U.S. Pat. No. 4,715,037, issued Dec. 29, 1987.

BACKGROUND OF THE INVENTION

1. Field of the Invention

The present invention relates to a bed frame assembly, and more particularly, but not by way of limitation, to an improved tiltable bed frame assembly wherein the position of the mattress can be selectively varied between an inclined position and a horizontal position.

2. Brief Description of the Prior Art

In order to facilitate patient treatment it is often recommended that the bedstead, and thus the mattress, be placed in an inclined position. To achieve the desired inclination of the bedstead in the home environment, objects such as books and bricks are often placed under the headboard or footboard attached to the bedstead. While allowing one to achieve the desired inclination of the mattress in such instances, this arrangement is undesirable in that the bedstead is unstable, the bed assembly is unsightly, and it is difficult to reposition the mattress and the bedstead to the normal horizontal position.

In an effort to overcome the above-mentioned makeshift provisions of providing the desired degree of inclination to the mattress, numerous bed assemblies and mattress constructions have been proposed by the prior art. However, many of the prior art devices are relatively large in size, unsightly in appearance, and are of high initial cost. Further, many of the prior art bed assemblies require one to alter the decor of the room; that is, the user is required to replace the normal bed assembly with the device of the prior art.

The tiltable bed frame assembly disclosed in my copending patent application, U.S. Ser. No. 899,488, now U.S. Pat. No. 4,715,073, overcomes many of the beforementioned disadvantages of the prior art bed assemblies and mattress constructions for inclination of a person supported on a mattress. The tiltable bed assembly disclosed in my before-mentioned co-pending patent application permits one to adjust the angular disposition of a mattress, while at the same time permitting one to utilize a conventional mattress and the headboard and footboard components of the user's bedroom suit.

The tiltable bedframe assembly disclosed in my copending patent application comprises a main frame, a mattress frame supported by the main frame, an inclined ramp assembly supported on the main frame so as to be disposed below the mattress frame and selectively moveable along the main frame, and a ramp engaging assembly connected to the mattress frame and supported on the inclined ramp assembly for moving a selected portion of the mattress frame relative to the main frame as the inclined ramp assembly is moved along the main frame. An actuation assembly, such as a linear actuator, is supported by the main frame and connected to the inclined ramp assembly so that upon actuation of the linear actuator the inclined ramp assembly is slideably moved in a to and fro direction a selected distance along the main frame and thereby alters the angular disposition of the mattress.

While the operation and durability of construction of the tiltable bed frame assembly described above has been satisfactory, additional improvements in such tiltable bed assemblies are desired in order to reduce the weight of the assembly and thereby enhance movement of the assembly to change the decor of the room, to simplify the construction of the assembly, and to provide an assembly which can be more economically manufactured. However, such an improved tiltable bed frame assembly should maintain the capabilities of providing the use of a standard mattress on the bed frame assembly, permit the desired inclination of the mattress, and still permit a conventional headboard to be used with the frame assembly so that the decor of the bed corresponds to the remaining decor of the room in which the bed is used. It is to such a bed frame assembly that the subject invention is directed.

SUMMARY OF THE INVENTION

According to the present invention, an improved tiltable bed frame assembly is provided which permits one to adjust the angular disposition of a mattress between a horizontally disposed position and an inclined position, while at the same time permitting one to utilize a conventional mattress and headboard of the user's bedroom suit. Broadly, the improved tiltable bed frame assembly comprises a main frame and a mattress frame pivotably supported by the main frame so that the mattress frame can be selectively pivoted to an angular position relative to the main frame. The main frame, a member having a substantially rectangular-shaped configuration, is formed of a plurality of elongated members rigidly interconnected so that the main frame has opposed, spatially disposed sides. The main frame further includes a plurality of post members which are substantially normally disposed relative to the elongated axis of the opposed sides. One of the post members is characterized as a foot post member and is positioned near one end of the main frame; another of the post members is characterized as a head post member and is positioned near an opposed end of the main frame, and still another post member is characterized as a center post member and is positioned intermediate the foot post member and the head post member. As will be more fully described hereinafter, the foot post member is provided with a length less than the length of the center post member to enable the mattress frame to be pivotably connected to the center post member and permit the desired angular disposition of the mattress frame relative to the main frame.

The mattress frame, which is pivotably supported by the center post member of the main frame, is provided with a substantially rectangular-shaped configuration formed of a plurality of elongated members rigidly interconnected so as to provide the mattress frame with opposed, spatially disposed sides. The mattress frame further includes a plurality of leg members which are substantially normally disposed relative to the elongated axis of the opposed sides of the mattress frame. One of the leg members (i.e. a foot leg member) is positioned near one end of the mattress so as to be aligned with the foot post member of the main frame; and another of the leg members (i.e. a head leg member) is positioned near an opposed end of the mattress frame so as to be aligned with the head post member of the main frame. The leg members of the mattress frame are connected to the foot post member and the head post member of the main frame by a linkage assembly so that the leg members of the mattress frame can be telescopically moved relative to the foot and head post members of the main frame during pivotal movement of the mattress frame. In order to secure and stabilize the mattress frame in the desired angular disposition, a locking assembly is supported by the main frame for selectively engaging the linkage assembly and thereby secure the leg members of the mattress frame to the foot post members of the main frame or the leg member of the mattress frame to the head post members of the main frame.

In an alternate embodiment the tiltable bed frame assembly comprises a mattress frame, a main frame assembly supported on a floor for pivotably supporting the mattress frame in an elevated disposition such that the mattress frame is pivotable on the main frame for selective angular disposition relative to the floor, and an elevating assembly for pivoting the mattress frame to the selected angular disposition. The elevating assembly includes a track member, a first support member having a lower end and an opposed upper end, and a power unit. The lower end of the first support member is slideably supported by the track member and the opposed upper end is pivotably attached to the mattress frame near one end thereof. The power assembly, which is connected to the first support member, selectively moves the lower end of the first support member along the track member so that the end of the mattress frame is elevated to pivot the mattress frame on the main frame in response to movement of the first support member.

An object of the present invention is to provide an improved tiltable bed frame assembly for use with a conventional mattress wherein the angular disposition of the mattress may be selectively moved between a horizontal position and an inclined position.

Another object of the present invention, while achieving the before-stated object, is to provide an improved tiltable bed frame assembly which can be attached to a conventional headboard so that the bed frame assembly does not detract from the decor of the room.

Another object of the present invention, while achieving the before-stated objects, is to provide an improved tiltable bed frame assembly which, when in a substantially horizontally disposed position, provides an appearance of a conventional bed, but which can be readily moved between the horizontal position and a desired inclined position.

Yet another object of the present invention, while achieving the above-stated objects, is to provide an improved tiltable bed frame assembly which is durable in construction, economical to manufacture, and which does not suffer from the aesthetic and functional disadvantages of the prior art devices.

Other objects, advantages and features of the present invention will become apparent to those skilled in the art from a reading of the following description when read in conjunction with the drawings and the appended claims.

DESCRIPTION

Figure 1:
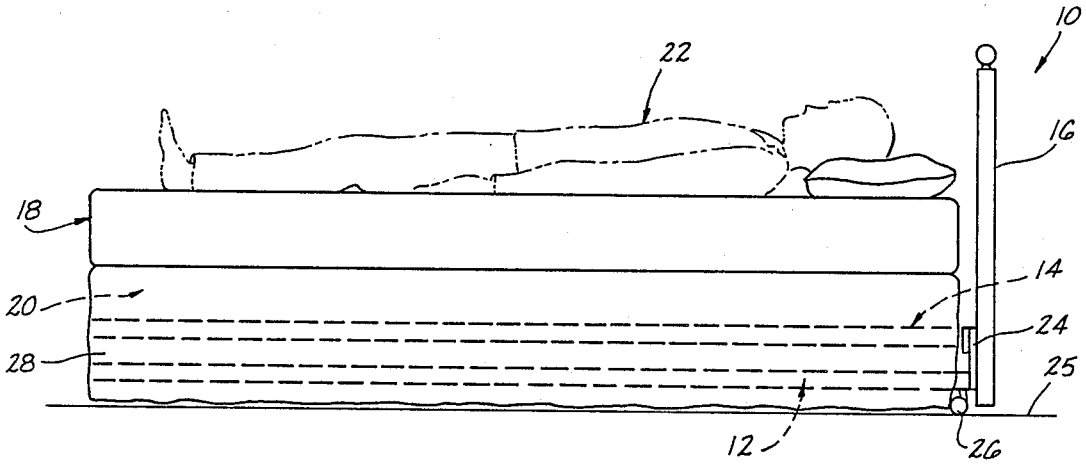
FIG. 1 is a side elevational view of an improved tiltable bed frame assembly constructed in accordance with the present invention, and illustrating a person supported on a conventional mattress and spring set in a horizontal position.
Figure 2:
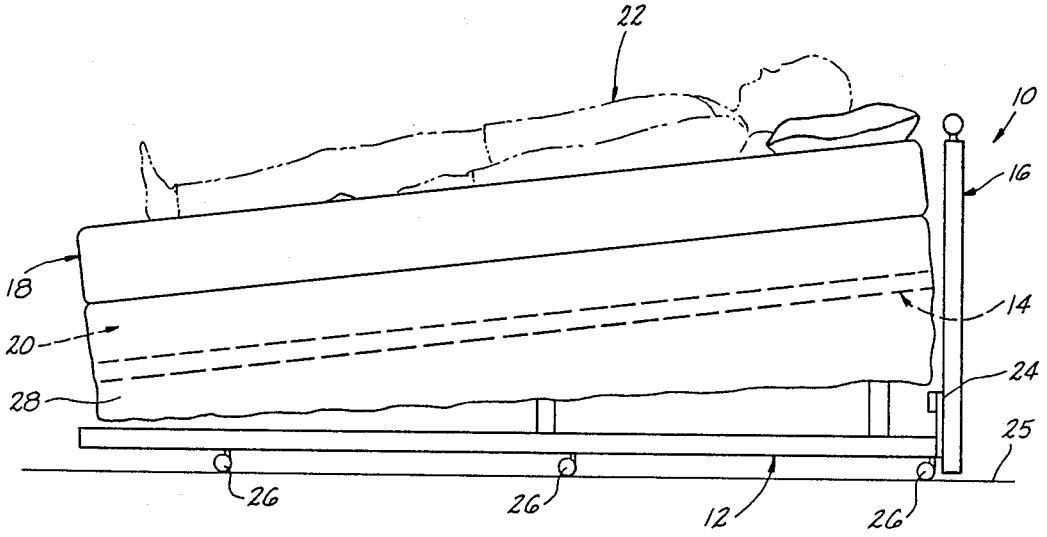
FIG. 2 is side elevational view of the tiltable bed frame assembly of FIG. 1 illustrating the person supported on a conventional mattress and spring set wherein same are disposed in an inclined position.

Referring now to the drawings, and more particularly to FIGS. 1 and 2, shown therein is a tiltable bed frame assembly 10 constructed in accordance with the present invention. The tiltable bed frame assembly 10 comprises a main frame 12 and a mattress frame 14 pivotably supported by the main frame 12. The main frame 12 is connectable to a conventional headboard 16 at one end thereof.

The mattress frame 14 supportingly receives a conventional mattress 18 and spring 20 so that a person 22 can be supported thereon. The construction of the main frame 12 and the mattress frame 14 permits one to use a conventional mattress; and the size of the main frame 12 and the mattress frame 14 can be fabricated for varying sizes of mattresses.

The connection of the main frame 12 to the headboard 16 can be achieved in a conventional manner by headboard brackets, such as brackets 24, mounted on one end of the main frame 12. Thus, it is not believed necessary that a detailed description of the connection of the main frame 12 to the headboard 16 be set forth in order to enable one to fully understand the construction and operation of the tiltable bed frame assembly 10 of the present invention. However, it should be noted that because of the unique design and construction of the tiltable bed frame assembly 10, the headboard 16 illustrated with the tiltable able bed frame assembly 10 can be a component of the user's bedroom suit so that the tiltable bed frame assembly 10 appears to be of conventional bed construction when the mattress frame 14 is in the horizontally disposed position.

In order to permit movement of the tiltable bed frame assembly 10 over a supporting surface, such as a floor 25, a plurality of casters 26 are connected to the main frame 12. In addition, in order to enhance the aesthetic qualities of the tiltable bed frame assembly 10, decorative panels or a mattress skirt, such as skirt 28, can be employed to conceal the components forming the main frame 12.

Figure 3:
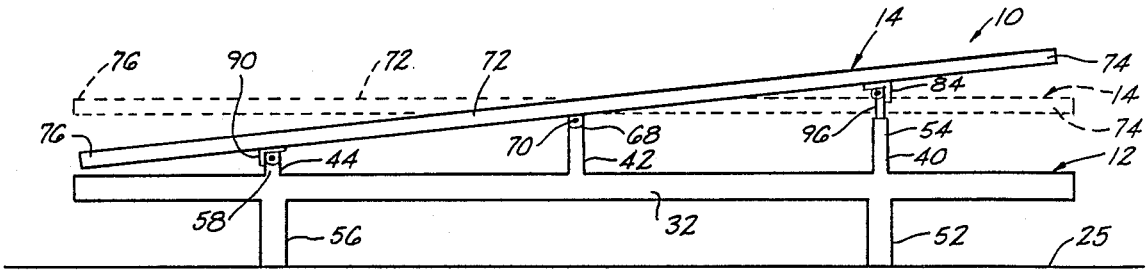
FIG. 3 is a side elevational view of the tiltable bed frame assembly of FIG. 1 illustrating a mattress frame in an angularly disposed position relative to a main frame, and showing by phantom lines the mattress frame in a horizontal position.
Figure 5:
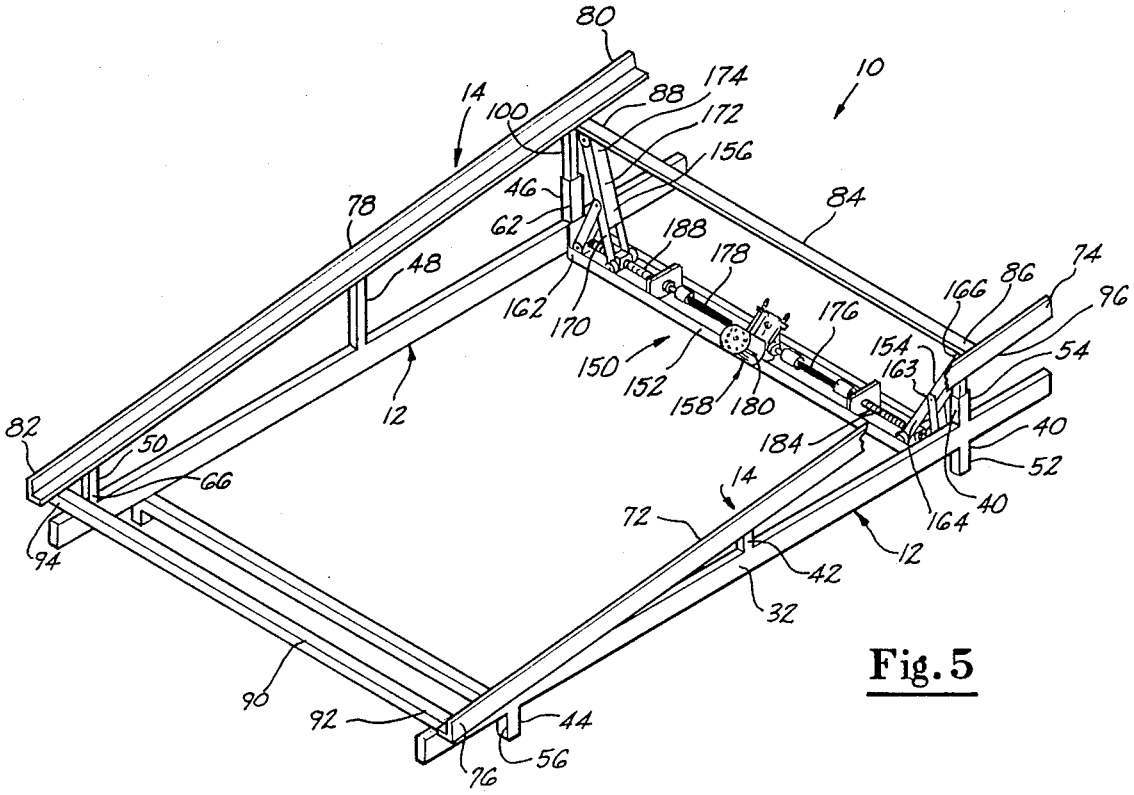
FIG. 5 is a partially broken, perspective view of the tiltable bed assembly of FIG. 1 having a power assembly for selectively positioning the mattress frame in one of the elevated or horizontal position relative to the main frame.

Referring now to FIGS. 3 and 5, the main frame 12 is illustrated as a substantially rectangularly shaped member having opposed, spatially disposed sides and at least one end. Any suitable means can be employed for fabricating the main frame 12. For example, the main frame 12 can be fabricated of a plurality of elongated members, such as elongated members 32, 34 and 36 which are rigidly interconnected so as to provide the main frame 12 with the desired substantially rectangularly shaped configuration when connected to the headboard 16. Further, if desired to provide additional strength and support to the main frame 12, an additional elongated member (not shown) can be connected to the ends of the elongated members 32 and 36 so as to be disposed substantially parallel to the elongated member 34.

In order to support the mattress frame 14, while at the same time permitting the pivotal movement of the mattress frame 14 between the substantially horizontally disposed position (FIG. 1) and the inclined position (FIG. 2), the main frame 12 further comprises post members 40, 42 and 44 which are substantially normally diposed relative to the elongated axis of the elongated member 32; and post members 46, 48 and 50 which are substantially normally disposed relative to the elongated axis of the elongated member 36.

The post members 44 and 50 are connected to the elongated members 32, 36, respectively, so that the post members 44 and 50 are aligned one with the other and disposed near one end of the elongated members 32, 36; and the post members 40 and 46 are connected to the elongated members 32, 36, respectively, so that the post members 32 and 36 are aligned one with the other and disposed near an opposed end of the elongated members 32, 36. Thus, the post members 44, 50 function as foot post members and the post members 40, 46 function as head post members for the main frame 12. The post members 42, 48, which are also aligned with each other, are disposed along the elongated members 32 and 36, respectively, at a position intermediate the foot and head post members so as to function as a fulcrum for the pivotal movement of the mattress frame 14.

The head post member 40 is a tubular member having a lower portion 52 and an upper portion 54; and the foot post member 44 is also a tubular member having a lower portion 56 and an upper portion 58. Similarly, the head post member 46 is a tubular member having a lower portion 60 and an upper portion 62; and the foot post member 50 is also a tubular member having a lower portion 64 and an upper portion 66. As will be more fully described hereinafter, the tubular construction of the head post members 40, 46 and the foot post members 44, 50 of the main frame 12 cooperate with elements of the mattress frame 14 so that the mattress frame 14 can be positioned and secured in a desired angular disposition relative to the main frame 12.

The post members 44 and 50 (i.e. the foot post members) of the main frame 12 have a length less than the length of the center post members 42, 48; and the post members 40, 46, (i.e. the head post members) have a length equal to or less than the length of the center post members 42, 48. It should be noted that the difference in length between the center post members 42, 48, and the foot post members 44, 50 can vary depending on the overall length of the main frame 12 and the mattress frame 14, and the amount of inclination desired when the mattress frame 14 is selectively moved to a fully inclined position relative to the main frame 12. In addition, since the center post members 42, 48 function as the pivot support or fulcrum for the mattress frame 14, it is desirable that the upper surface of each of the center post members 42, 48 have an arcuate configuration so that the pivotal movements of the mattress frame 14 supported thereon can be achieved without any binding effect.

While the main frame 12 has been illustrated as fabricated of the plurality of elongated members as described above, it should be understood that the main frame 12 functions primarily as a support for the mattress frame 14. Thus, the structural configuration of the main frame 12 can be varied without departing from the spirit of the present invention, provided that the main frame 12 functions in the described manner. However, in such instances, care must be exercized to provide the main frame 12 with sufficient height so that the mattress frame 14 does not engage the supporting surface, such as the floor 25, when the mattress frame 14 is moved to the inclined position.

The mattress frame 14, (which is also provided with a substantially rectangular configuration), can be pivotally connected to the center post members 42, 48 of the main frame 12 by any suitable means, such as bracket 68 supported by the mattress frame 14, (see FIG. 3), adapted to receive the upper ends of the center post members 42, 48. Thereafter, the center post members 42, 48 can be pivotally connected to the brackets of the mattress frame 14 by pins, such as pin 70.

The mattress frame 14 comprises an elongated side member 72 having a first end 74 and an opposed second end 76; and a substantially parallel, spatially disposed elongated side member 78 having a first end 80 and an opposed second end 82. The mattress frame 14 further comprises an elongated end member 84 having a first end 86 and a second end 88; and an elongated end member 90 having a first end 92 and a second end 94. The elongated end member 84 is disposed between the elongated side members 72, 78 near the first ends 74, 80 thereof such that the first end 86 of the elongated end member 84 is connected to the elongated side member 72 and the second end 88 of the elongated end member 84 is connected to the elongated side member 78.

Similarly, the elongated end member 90 is disposed between and connected to the elongated side members 72, 78, near the second ends 76, 82 thereof such that the first end 92 of the elongated end member 90 is connected to the elongated side member 72 and the second end 94 of the elongated end member 90 is connected to the elongated side member 78. Thus, the connection of the elongated side members 72, 78 and the elongated end members 84, 90 provides the mattress frame 14 with a substantially rectangularly shaped configuration substantially as shown.

To assist in the interconnection of the mattress frame 14 to the main frame 12, as well as to stabilize the mattress frame 14 in either an inclined or horizontally disposed position relative to the main frame 12, the mattress frame 14 further comprises leg members 96 and 98 substantially normally disposed relative to the elongated axis of the elongated side member 72, and leg member 100, 102 substantially normally disposed relative to the elongated axis of the elongated side member 78. The leg members 96, 100 are connected to the elongated side members 72, 78, respectively, near one end thereof such that the leg member 96 is positionable within the head post member 40 and the leg member 100 is positionable within the head post member 46 of the main frame 12. Similarly, the leg members 98, 102 are connected to the elongated side member 72, 78, respectively, near an opposed end thereof such that the leg member 98 is positionable within the foot post member 44 and the leg member 102 is positionable within the foot post member 50 of the main frame 12. That is, the leg members of the mattress frame 14, are telescopically movable within the head and foot post members of the main frame 12 when the mattress frame is moved between the horizontally disposed position and an inclined position relative to the main frame 12.

Figure 4:
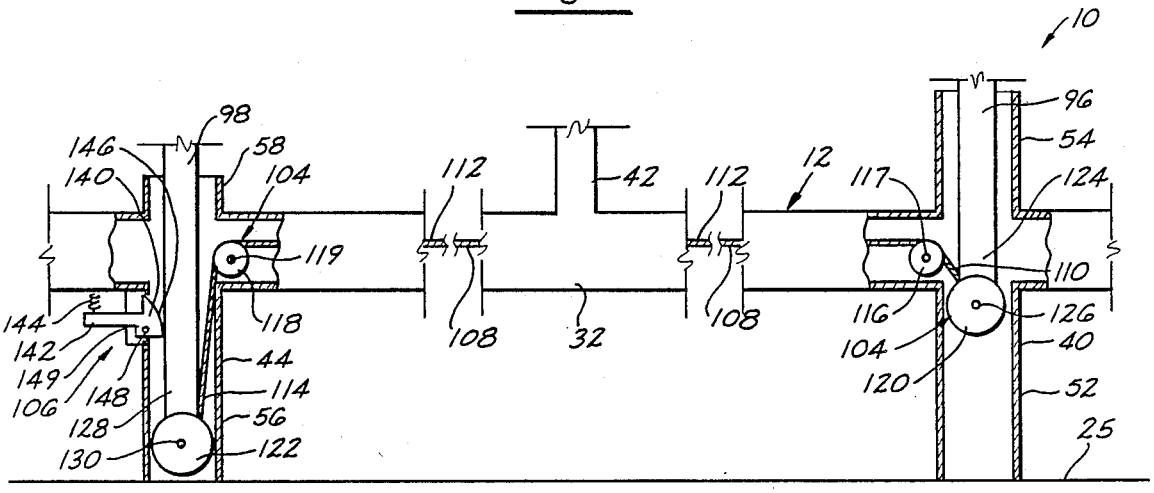
FIG. 4 is a fragmentary, partially broken, crosssectional side elevational view of one embodiment of a linkage assembly for interconnecting the mattress frame to the main frame so as to provide selectively angular disposition of the mattress frame.

The tiltable bed assembly 10 further comprises a linkage assembly 104 for connecting the leg members of the mattress frame 14 to the head and foot post members of the main frame 12; and a locking assembly 106 for securing and locking the mattress frame 14 in a predetermined position relative to the main frame. Referring now to FIG. 4, the linkage assembly 104 and the locking assembly 106 which are supported by the elongated member 32 and the head and foot post members 40, 44 of the main frame 12, and the interconnection of the leg members 96, 98 of the mattress frame 14 to the head and foot post members 40, 44 of the main frame 12 is illustrated. It is to be understood that a similar linkage assembly and locking assembly are supported by the elongated member 36 and the head and foot post members 46, 50 of the main frame 12 for connecting the leg members 100, 102 of the mattress frame 14 to the head and foot post members 46, 50 of the main frame 12, as well as for securing and locking the mattress frame 14 in the selected position. However, since the structure and function of the linkage assembly and locking assembly supported by the elongated member 36 and the head and foot post member 46, 50 are identical in construction to the linkage assembly 104 and the locking assembly 106 supported by the elongated member 32 and the head and foot post members 42, 44 of the main frame 12, only the linkage assembly 104 and the locking assembly 106 illustrated in FIG. 4 will be described.

The linkage assembly 104 comprises a linkage member, (such as a cable 108 having a first end portion 110, a medial portion 112 and an opposed second end portion 114), a pair of idler or cable guide rollers 116, 118, and a pair of guide rollers 120, 122. The elongated side member 32 of the main frame 12 is desirably fabricated of tubular material for housing the cable 108 and the cable guide rollers 116 and 118. As illustrated in the drawing, the cable guide roller 116 is secured within the channel of the elongated side member 32 via axle pin 117 for rotational movement; and cable guide roller 116 is positioned substantially adjacent the intersection of the channel through the elongated side member 32 and the channel defined by the lower and upper portions 52, 54 of the tubular head post member 40. Similarly, the cable guide roller 118 is secured within the passageway of the elongated side member 32 via axle pin 119 for rotational movement; and the cable guide roller 118 is positioned substantially adjacent the intersection of the channel through the elongated side member 32 and the channel defined by the lower and upper portions 56, 58 of the tubular foot post member 44.

The guide roller 120 (which is adapted to travel through the channel defined by the lower and upper portions 52, 54 of the tubular head post member 40 of the main frame 12) is connected to a distal end 124 of the leg member 96 of the mattress frame 14 by an axle pin 126; and the guide roller 122 (which is adapted to travel through the channel defined by the lower and upper portions 56, 58 of the tubular foot post member 44 of the main frame 12) is connected to a distal end 128 of the leg member 98 of the mattress frame 14 by an axle pin 130. Thus, the guide rollers 120, 122 stabilize the leg members of the mattress frame 12 as the leg members travel through the channels defined by the head and foot post members of the main frame when the mattress frame 14 is being moved to a desired inclined or horizontal position relative to the main frame 12.

The first end portion 110 of the cable 108 is connected to the distal end 124 of the leg member 96 and the opposed second end portion 114 of the cable 108 is connected to the distal end 128 of the leg member 98 so that the medial portion 112 of the cable is supported by the cable guide rollers 116, 118. Thus, the cable 108 travels through the channel of the elongated side member 32 of the main frame 12 in response to the telescopic movement of the leg members 96, 98 of the mattress frame 14 in the channels defined by the head and foot post members 40, 44 of the main frame 12.

The pivotal connection of the mattress frame 14 to the main frame 12, together with the telescopic interconnection of the leg members of the mattress frame 14 to the head and foot post members of the main frame 14 and the interconnection of the distal ends of the leg members of the mattress frame via the linkage assembly 104, permits the angular disposition of the mattress frame to be easily and quickly accomplished. Further, the locking assembly 106 secures the mattress frame 14 in the desired angular position The locking assemblies 106 are interconnected and adapted to frictionally engage and thereby secure the leg members of the mattress frame 14 in a desired position relative to the foot post members of the main frame 12.

Since the locking assemblies are identical in construction and function, only the locking assembly 106 supported by the foot post member 44 of the main frame 12 and adapted to engage the leg member 98 of the mattress frame 14 will be described. As illustrated in FIG. 4, the locking assembly comprises a cam member 140 and a lever 142 connected to the cam member 140, a spring 144 biases the cam member 140 in a frictionally engaging locking position with the leg member 98 of the mattress frame 14.

The cam member 140, which is provided with an arcuate shaped cam surface 146, is pivotally supported in the lower portion 56 of the foot post member 44 by a pivot pin 148 so that in the biased position the arcuate shaped cam surface 146 of the cam member 140 frictionally engages the leg member 98 to prevent undesired movement of the leg member 98 within the foot post member 44. The lever 142 extends outwardly through a slot 149 formed in the lower portion 56 of the foot post member 44 of the main frame 12 and is connected to a foot pedal (not shown). The spring 144 is disposed between the lever 142 and the adjacently disposed portion of the elongated side member 32 of the main frame 12 substantially as shown.

To release the cam member 140 from locking engagement with the leg member 98 of the mattress frame 14 (so that the angular disposition of the mattress frame 14 can be altered), a downwardly directed force is applied to the lever 142 via the foot pedal (not shown). The downwardly directed movement of the lever 142 causes the cam member 140 to be rotated in an upward direction so as to disengage the arcuate shaped cam surface 146 of the cam member 140 from the leg member 98. When the mattress frame 14 has been selectively repositioned relative to the main frame 12 the force applied to the lever 142 is released. Thereupon, the spring 144 causes the cam member 140 to be biased again to the locking engagement position with the leg member 98.

As previously stated, a locking assembly such as the locking assembly 106 for engaging the leg members of the mattress frame 14 is supported by each of the foot post assemblies of the main frame 12. To assist in releasing the locking assemblies a connecting rod can be secured to each of the locking assemblies so that upon applying a downwardly directed force to the lever via the attached foot pedal of one of the locking assemblies a simultaneous downwardly directed force is applied to the lever of the other locking assembly so that the locking assemblies are simultaneously released.

The tiltable bed assembly 10 may further comprise an elevating assembly 150 for pivoting the mattress frame 14 to the desired angular disposition. When employing the elevating assembly 150 the locking assembly 106 heretofore described can be eliminated because the elevating assembly 150 also functions as a locking mechanism for securing the mattress frame 14 in the desired position. However, it may be desirable to employ the linkage assembly 150 to enhance the stability of the mattress frame 14 to the main frame 12.

Figure 6:
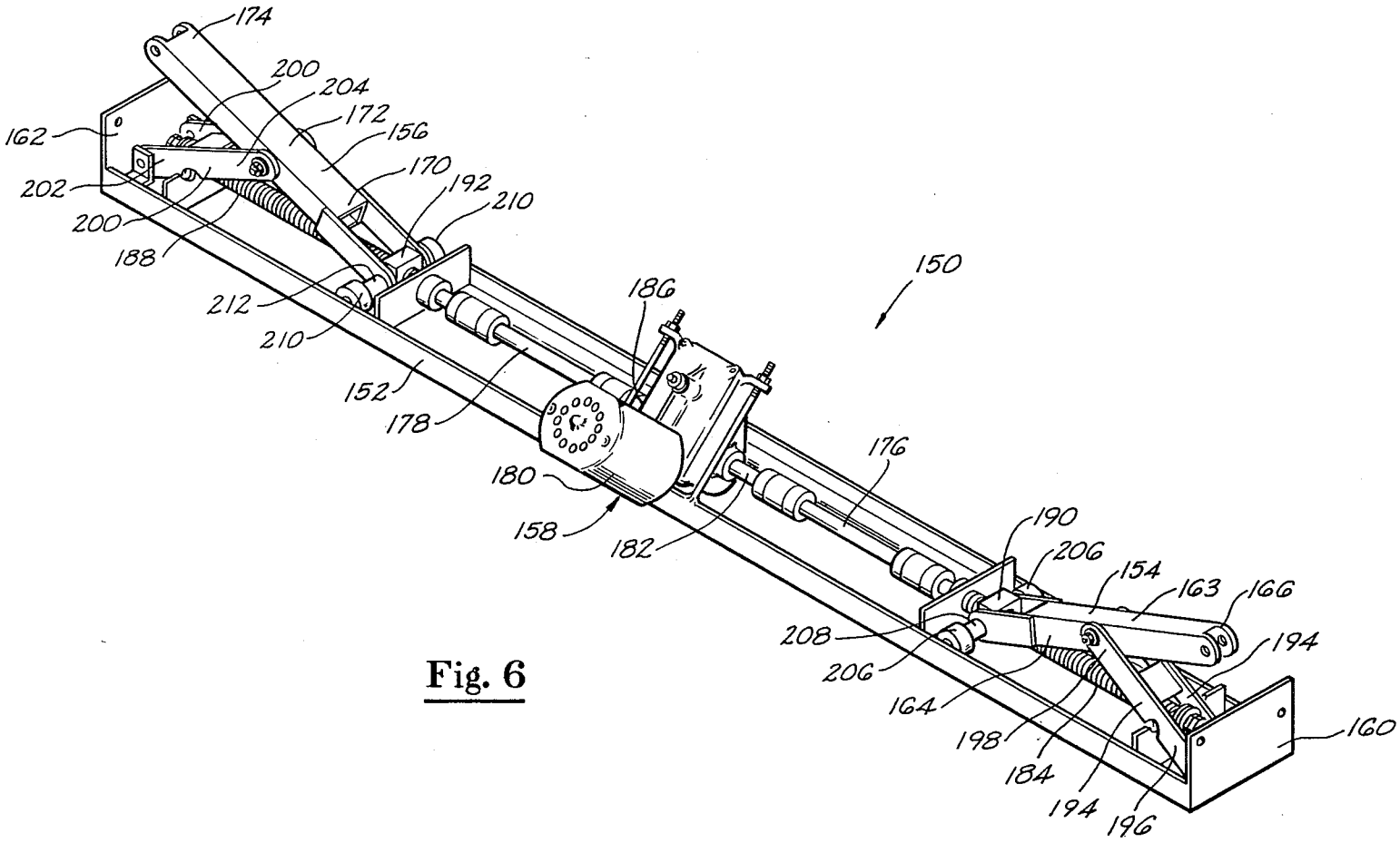
FIG. 6 is a perspective view of the power assembly for elevating the mattress frame to an angularly disposed position relative to the main frame.

The elevating assembly 150 is disposed between and connected to the main frame 12 and the mattress frame 14 such that one end of the mattress frame 14 can be selectively elevated to provide the mattress frame 14 with a desired angular disposition relative to the main frame 12. As shown in FIGS. 5 and 6, the elevating assembly 150 comprises a track member 152, a pair of support members 154, 156 and a power assembly 158. The track member 152 is a substantially U-shaped member having a first end 160 and an opposed second end 162. The first end 160 of the track member 152 is connected to the elongated member 32 of the main frame 12, and the second end 162 thereof is connected to the elongated member 36 of the main frame 12 substantially as shown. That is, the track member 152 is connected near one end portion of the main frame 12 so that the elongated axis of the track member 152 is substantially normal to the elongated axis of the elongated members 32 and 36; and the track member 150 is positioned below the end portion of the mattress frame 14 which is to be selectively movable to an elevated position.

The support member 154 is characterized as having a lower end 164, a medial portion 163 and an opposing upper end 166; and the support member 156 is characterized as having a lower end 170, a medial portion 172 and an opposing upper end 174. The lower end 164 of the support member 154 is slideably supported by one end portion of the track member 152; and the opposing upper end 168 of the support member 154 is pivotally attached to the elongated end member 84 of the mattress frame 14 near the first end 86 thereof. Similarly, the lower end 170 of the support member 156 is slideably supported by an opposite end portion of the track member 152; and the opposing upper end 174 of the support member 156 is pivotally attached to the elongated end member 84 of the mattress frame 14 near the opposed second end 88 thereof.

The power assembly 158 is operably connected to the lower ends 164, 170 of the support members 154, 156, respectively, so that the lower ends 164, 170 of the support members 154, 156 can be simultaneously and synchronizingly moved either toward each other or away from each other. The movement of the lower ends 164, 170 of the support members 154, 156 along the track member 152 permits the angular disposition of the mattress frame 14 to be altered relative to the main frame 12.

The power assembly 158 comprises a pair of linkage members 176, 178 and a reversible motor 180. One end 182 of the linkage member 176 is operably connected to a drive shaft (not shown) of the motor 180; and an opposed second end portion 184 of the linkage member 176 provided with right-handed threads. Similarly, one end 186 of the linkage member 178 is operably connected to the drive shaft of the motor 180; and an opposed second end portion 188 is provided with left-handed threads.

The elevating assembly 150 further comprises a pair of traveler members 190, 192. The traveler members 190, 192, which are provided with threaded bores (not shown) extending therethrough are pivotally connected to the first support members 154, 156 substantially as shown. The threaded bore of the traveler member 190 is adapted to threadingly receive the right-handed threads on the opposed second end 184 of the linkage member 176; whereas the threaded bore of the traveler member 192 is adapted to threadingly receive the left-handed threads on the opposed second end portion 188 of the linkage member 178. When the motor 180 is actuated the linkage members 176, 178 rotate in response to the directional rotation of the drive shaft of the motor 180. Thus, the treaded end portions 184, 188 of the linkage members 176, 178 serve as gear drive assemblies for the traveler members 190, 192.

To stabilize the support members 154, 156, the power assembly 158 further comprises a pair of stabilizing struts 194 having a first end 196 and an opposed second end 198, and a pair of stabilizing struts 200 having a first end 202 and an opposed second end 204. The first end 196 of the struts 194 are connected to one end of the track member 150 such that the struts 194 are spatially disposed and adapted to receive the support member 154 therebetween; and the opposed second ends 198 of the struts 194 are pivotally connected to the medial portion 163 of the support member 154. Similarly, the first ends 202 of the struts 200 are connected to the opposed end of the track 150 such that the struts 200 are spatially disposed and adapted to receive the support member 156 therebetween; and the opposed second ends 204 of the struts 200 are pivotally connected to the medial portion 172 of the support member 156.

To enhance the movement of the support members 154, 156 along the track member 152, the elevating assembly 150 further comprises wheels 206 connected for rotational movement to a pivot member 208, and wheels 210 connected for rotational movement to a pivot member 212. The pivot member 208 is connected to the lower end 164 of the support member 154 so as to pivotally support the traveler member 190. Similarly, the pivot member 212 is connected to the lower end 170 of the support member 156 so as to pivotally support the traveler member 192.

In order to provide versatility to the elevating assembly 150, that is, to construct the elevating assembly so that the overall length can be varied to accommodate varying widths of bed frames, the track member 152 can be fabricated of sections which are secured together by a plurality of bolts and nuts. In such instance, coupler members (not shown) can be used to alter the effective length of linkage members 176 and 178.

Figure 7:
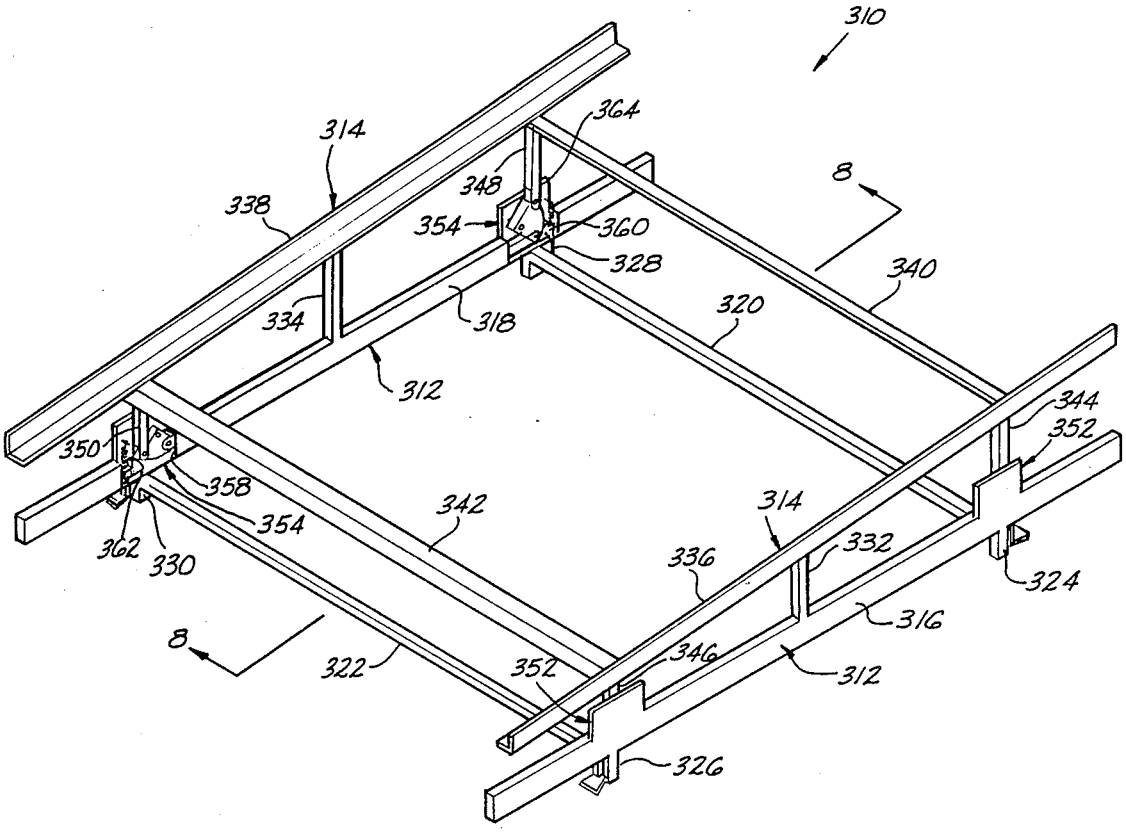
FIG. 7 is a perspective view of another embodiment of an improved tiltable bed frame assembly of the present invention wherein a mattress frame is disposed at an inclined position relative to a main frame.
Figure 8:
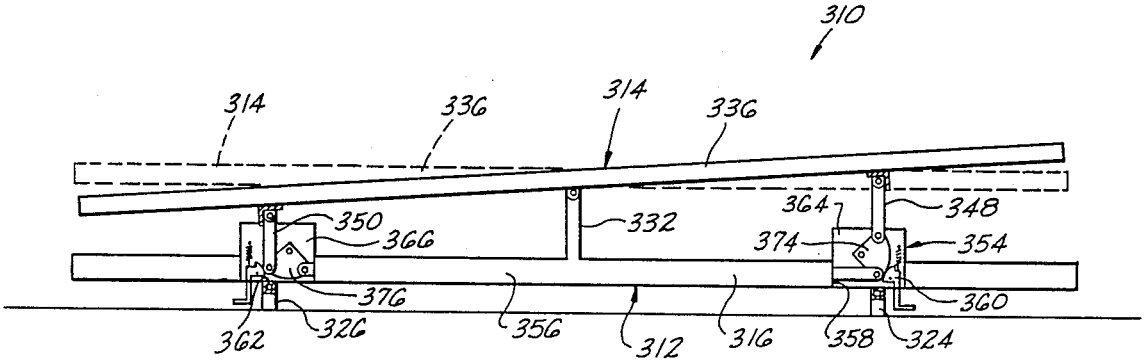
FIG. 8 is a side elevational view of the tiltable bed assembly of FIG. 7 taken along 8—8 and illustrating, by phantom lines, the mattress frame disposed in a horizontal position.

Referring now to FIGS. 7 and 8, a tiltable bed frame assembly 310 is illustrated comprising a main frame 312 for pivotally supporting a mattress frame 314 in an elevated disposition such that the mattress frame 314 can be pivoted on the main frame 312 for selective angular disposition. The main frame 312 comprises parallel, spatially disposed, elongated side members 316, 318 interconnected near their respective end portions by elongated end members 320, 322 substantially as shown in FIG. 7. Leg members 324 and 326 are connected to the side member 316 so that the leg members 324, 326 extend in a downward direction from the elongated side member 316; and leg members 328, 330 are connected to the side member 318 so that the leg members 328, 330 extend in a downward direction from the elongated side member 318.

In order to pivotally support a midportion of the mattress frame 314 at a predetermined height above the main frame 312, while at the same time permitting the pivotal movement of the mattress frame 314 between the inclined position and the horizontally disposed position, the main frame 312 further comprises an upwardly extending post member 332 connected to a midportion of the elongated side member 316 and an upwardly extending post member 334 connected to a midportion of the elongated side member 318 so as to be aligned with the post member 332. Post members 332, 334 function as a pivot support or fulcrum for the mattress frame 314. Thus, the upper surfaces of the post members 332 and 334 are desirably provided with an arcuate configuration so that the mattress frame 314 can be supported by the post member 332, 334 for pivotal movement of the mattress frame 314 without binding.

The mattress frame 314 (which is constructed similarly to the mattress frame 14 heretofore described) comprises parallel, spatially disposed, elongated side members 336, 338 interconnected near their respective end portions by elongated end members 340, 342. Thus, the mattress frame 314 is provided with a substantially rectangular shaped configuration corresponding to the configuration of the main frame 312.

To assist in the interconnection of the mattress frame 314 to the main frame 312, as well as to stabilize and support the mattress frame 314 in either the inclined or horizontally disposed position, the mattress frame 314 further comprises leg members 344, 346 substantially normally disposed relative to the elongated axis of the elongated side member 336, and leg members 348, 350 substantially normally disposed relative to the elongated axis of the elongated side member 338. The leg member 344 of the mattress frame 314 is pivotally connected to one end of a linkage assembly 352 supported by the elongated side member 316 of the main frame 312; and the leg member 346 of the mattress frame 314 is pivotally connected to an opposed second end of the linkage assembly 352. Similarly, the leg member 348 of the mattress frame 314 is pivotally connected to one end of a linkage assembly 354 supported by the elongated side member 318 of the main frame 312; and the leg member 350 of the mattress frame 314 is pivotally connected to an opposed second end of the linkage assembly 354.

Figures 9, 9A:
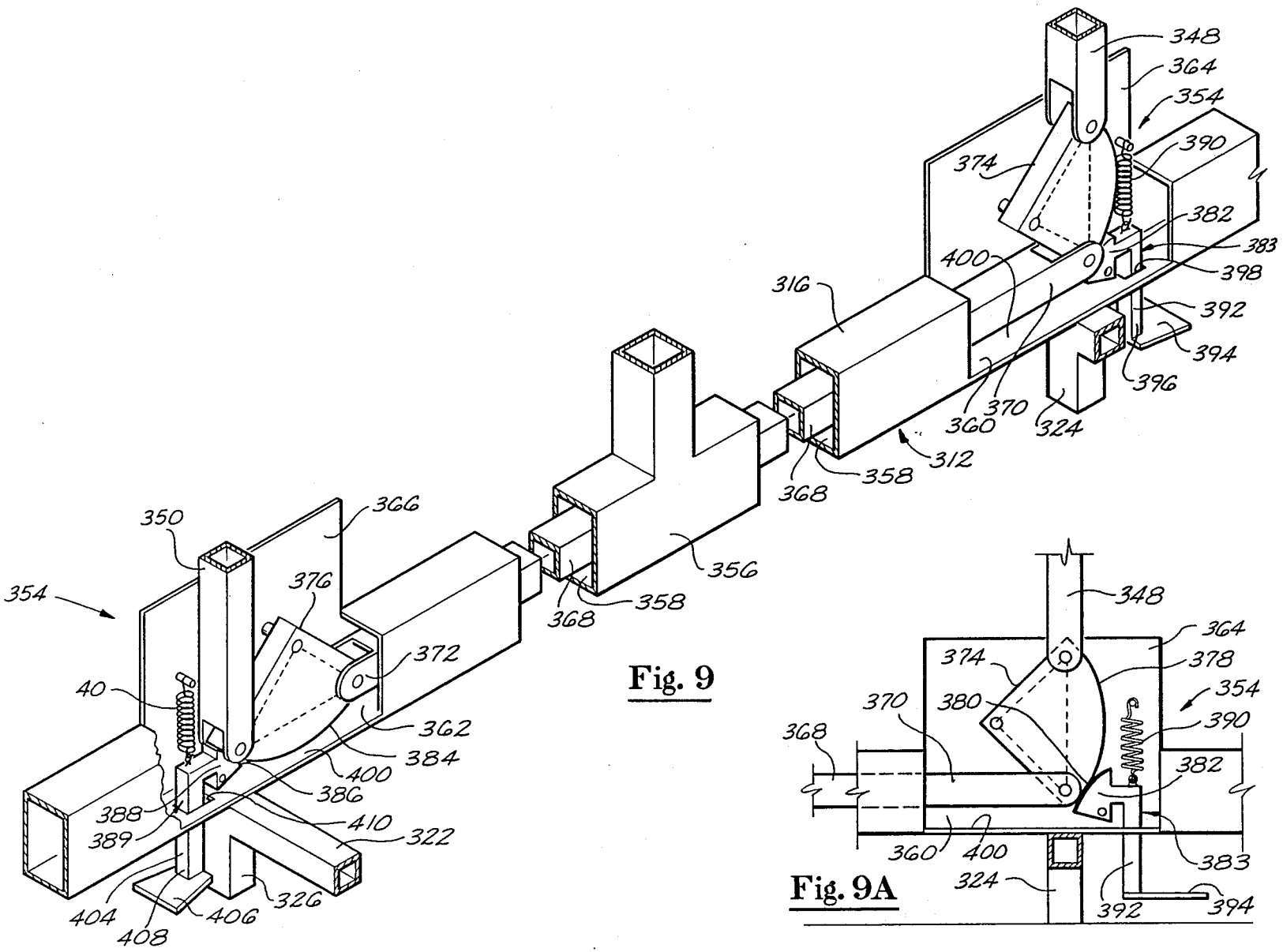
FIG. 9 is a fragmentary, partially broken, crosssectional perspective view of a second embodiment of a linkage assembly for interconnecting the mattress frame to the main frame and providing selective angular disposition of the mattress frame relative to the main frame.
FIG. 9A is a fragmentary, side elevational view of the interact of the linkage assembly of FIG. 9 and a locking mechanism for securing the mattress frame in the desired angular disposition.

The linkage assemblies 352, 354 employed to connect the mattress frame 314 to the main frame 312 are identical in construction and operation. Thus, only the linkage assembly 354 will be described in detail hereinafter with reference to FIGS. 9 and 9A. The elongated side member 318 of the main frame 312 is illustrated in FIG. 9 as an elongated channel member 356 defining an elongated channel 358 extending therethrough A slot 360 is formed in one end of the channel member 356, and a slot 362 formed in an opposed second end of the channel member 356 substantially as shown. A support plate 364 extends upwardly from a portion of elongated side member 318 defining the slot 360 for pivotally securing one end of the linkage assembly 354 within the slot 360; a support plate 366 extends upwardly from a portion of the elongated side member 318 defining the slot 362 for pivotally securing an opposed second end of the linkage assembly with the slot 362.

The linkage assembly 354, while interconnecting the leg members 348, 350 of the mattress frame 314 to the elongated side member 318 of the main frame 312, comprises an elongated linkage member 368 having a first end 370 and an opposed second end 372, a first cam follower 374 pivotally connected to the first end 370 of the linkage member 368, and a second cam follower 376 pivotally connected to the opposed second end 372 of the linkage member 368. The positioning of the elongated linkage members within the channel 358 and the positioning of the first and second cam followers 374, 376 with the slots 360, 362 (in combination with the configuration of the first and second cam followers 374, 376, the pivotal connection of the cam followers 374, 376 to the support plates 364, 366, the pivotal connection of the first and second cam followers 374, 378 to the first and opposed second ends 370, 372 of the elongated linkage member 368 and the pivotal connection of the first and second cam followers 374, 376 to the leg members 348, 350 of the mattress frame 314) maintains the linkage member 368 in a substantially horizontally disposed position while at the same time permitting the linkage member 368 of the linkage assembly 354 to move in an upward and downward direction within the channel 358 as the angular disposition of the mattress frame 314 is altered relative to the main frame 312. That is, the first cam follower 374 is constructed with an equilateral triangular pivot arrangement for pivotal connection of the first cam follower 374 to the leg member 348 of the mattress frame 314, to the first end 370 of the linkage member 368 and to the support plate 364; and the second cam follower 376 is likewise constructed with an equilateral triangular pivot arrangement for connection of the second cam follower 376 to the leg member 350 of the mattress frame 314, to the opposed second end 372 of the linkage member 368 and to the support plate 366.

The first cam follower 374 is further characterized as having an arcuate shaped side portion 378 so that the side portion 378 can be tangentially interfaced with an arcuate surface 380 of a spring biased first cam 382 of a first locking assembly 383 which is pivotally connected to the channel member 356 substantially as shown in FIGS. 9 and 9A. Thus, the first cam 382 is adapted to engage the arcuate side portion 378 of the cam follower 374 to lock the first cam follower 374 in a selected position corresponding to the desired angular disposition of the mattress frame 314. Similarly, the second cam follower 376 is characterized as having an arcuate shaped side portion 384 so that the side portion 384 can be tangentially interfaced with an arcuate surface 386 of a spring biased second cam 388 of a second locking assembly 389 which is pivotally connected to the channel member 356 near an opposed second end of the channel member 356 substantially as shown in FIG. 9. Thus, the second cam 388 is adapted to engage the arcuate side portion of the second cam follower 376 to lock the second cam follower 376 in a selected position corresponding to the desired angular disposition of the mattress frame 314.

The first locking assembly 383, in addition to the first cam 382, comprises a spring 390 for biasing the first cam 382 in an engaging position with the first cam follower 374. A strut 392 is connected at one end to the first cam 382; and a foot plate 394 is connected to a distal end 396 of the strut 392. A strut receiving opening 398 is provided in a lower side 400 of the channel member 356 defining the slot 360 such that the strut receiving opening 398 is disposed at the outwardmost end portion of the slot 360. The strut 392 extends through the strut opening 398 so that one can have access to the foot plate 394 and selectively disengage the locking interaction between the first cam 382 and the first cam follower 374. The spring 390 is connected at one end to the support plate 364; and the other end of the spring is connected to the strut 392. Thus, the spring 390 biases the first cam 382 for engagement with the first cam follower 374.

The second locking assembly 389, which is identical in construction to the first locking assembly 383, comprises, in addition to the second cam 388, a spring 402 for biasing the second cam 388 in an engaging position with the second cam follower 376. A strut 404 is connected at one end to the second cam 388; and a foot plate 406 is connected to a distal end 408 of the strut 404. A strut receiving opening 410 is provided in a lower side 400 of the channel member 356 defining the slot 362 such that the strut opening 410 is disposed at the outwardmost end portion of the slot 362 The strut 404 extends through the strut opening 410 so that one can have access to the foot plate 406 and selectively disengage the locking interaction between the second cam 388 and the second cam follower 376. The spring 402 is connected at one end to the support plate 366; and the other end of the spring is connected to the strut 404. Thus, the spring 402 biases the second cam 388 for engagement with the second cam follower 376.

It should be noted that the configuration of the first cam follower 374 and the first cam 382, as well as the second cam follower 376 and the second cam 388, together with the tangential interfaces formed therebetween, permit the first cam 382 to lockingly secure the first cam follower 374 in a stationary position which results in the mattress frame 314 being maintained in the desired angular position relative to the main frame 312, while the second cam follower 376 can freely travel along the second cam 388. Similarly, when the second cam follower 376 is in a locking position relative to the second cam 388, the first cam follower 374 can freely travel along the first cam 382. Thus, the angular disposition of the mattress frame 314 can be easily altered by applying a downward force on the appropriate foot pedal of the locking assembly in which the cam is in locking engagement with the cam follower. Once the mattress frame 314 has been selectively positioned relative to the main frame 312, the locking assembly is automatically placed in the locking mode for securing the mattress frame 314 in the desired position by merely releasing the pressure on the foot pedal. It should also be noted that the elongated side member 316 is provided with a linkage and locking assemblies identical to the linkage assembly 354, the first locking assembly 383 and the second locking assembly 389 hereinbefore described. Thus, for ease of operation it is desired that the locking assemblies supported by the foot portion of the bed frame be interconnected so that upon depressing the foot pedal of either of the locking assemblies the locking assemblies are each positioned in their release mode. Similarly, the locking assemblies supported by the head portion of the bed frame are also desirably interconnected so that by depressing the foot pedal of either of the locking assemblies the locking assemblies are each positioned in their release mode. Any suitable means can be employed for interconnecting the various locking assemblies, such as a rod member extending therebetween and connected to the foot pedals or the supporting struts.

Figure 10:
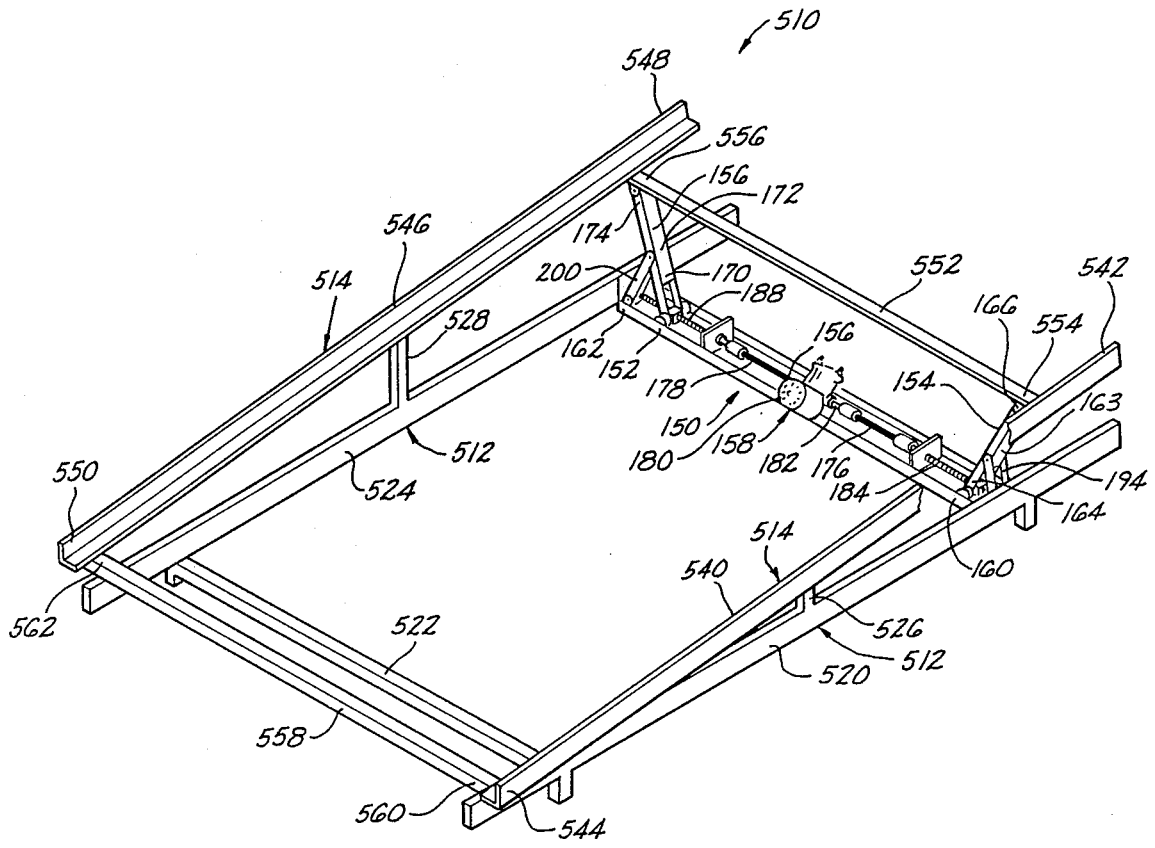
FIG. 10 is a perspective view of another embodiment of an improved tiltable bed frame assembly constructed in accordance with the present invention and incorporating therein the power assembly of FIG. 6 for selectively elevating a mattress frame to an angular disposition relative to a main frame.

Referring now to FIG. 10, another embodiment of a tiltable bed frame assembly 510 is illustrated. The tiltable bed frame assembly 510 comprises a main frame 512 and a mattress frame 514 pivotably supported by the main frame 512. The main frame 512 can be connected to a conventional headboard (not shown) at one end thereof.

The connection of the main frame 512 to the headboard can be achieved by any manner well known in the art. Thus, no further comments are deemed necessary as to the connection of the main frame 512 to the headboard in order to enable one to fully understand the construction and operation of the tiltable bed frame assembly 510 of the present invention. However, it should be noted that because of the unique design and construction of the tiltable bed frame assembly 510, the headboard can be a component of the user's bedroom suit so that the tiltable bed frame assembly 510 appears to be of conventional bed construction when the tiltable bed frame assembly 510 is in the horizontally disposed position.

To permit movement of the tiltable bed frame assembly 510 over a supporting surface a plurality of casters can be connected to the main frame 512. In addition, in order to enhance the aesthetic qualities of the tiltable bed frame assembly 510, decorative panels or a mattress skirt can be employed to conceal the components forming the tiltable bed assembly 510.

The main frame 512 is illustrated as a substantially rectangularly shaped member having opposed, spatially disposed sides and at least one end. Any suitable means can be employed for fabricating the main frame 512. For example, the main frame 512 can be fabricated of a plurality of elongated members, such as elongated members 520, 522 and 524 which are rigidly interconnected to provide the main frame 512 with a substantially rectangularly shaped configuration when connected to the headboard.

In order to support the mattress frame 514, while at the same time permitting the pivotal movement of the mattress frame 514 between the substantially horizontally disposed position (FIG. 1) and the inclined position (FIG. 2), the main frame 512 further comprises a center post member 526 which is substantially normally disposed relative to the elongated axis of the elongated member 520; and a post member 528 which is substantially normally disposed relative to the elongated axis of the elongated member 524. The post members 526, 528 function as a fulcrum for the pivotal movement of the mattress frame 514; and the post members 526, 528 are connected to the elongated members 520, 524, respectively, so that the post members 526 and 528 are aligned.

While the main frame 512 has been illustrated as fabricated of the plurality of elongated members, it should be understood that the main frame 512 functions primarily as a support for the mattress frame 514. Thus, the structural configuration of the main frame 512 can be varied without departing from the spirit of the present invention, provided that the main frame 512 functions in the described manner. However, in such instances, care must be exercized to provide the main frame 512 with sufficient height so that the mattress frame 514 does not engage the supporting surface, such as the floor, when the mattress frame 514 is moved to the inclined position.

The mattress frame 514, (which is also provided with a substantially rectangular configuration), can be pivotally connected to the post members 526, 528 of the main frame 512 by any suitable means, such as a bracket (not shown) supported by the mattress frame 514. Thus, the upper ends of the post members 526, 528 can be pivotally connected to the brackets of the mattress frame 514 by any suitable means, such as a pin.

The mattress frame 514 comprises an elongated side member 540 having a first end 542 and an opposed second end 544; and a substantially parallel, spatially disposed elongated side member 546 having a first end 548 and an opposed second end 550. The mattress frame 514 further comprises an elongated end member 552 having a first end 554 and a second end 556; and an elongated end member 558 having a first end 560 and a second end 562. The elongated end member 552 is disposed between the elongated side members 540, 546 near the first ends 542, 548 thereof such that the first end 554 of the elongated end member 552 is connected to the elongated side member 540 and the second end 556 of the elongated end member 552 is connected to the elongated side member 546.

Similarly, the elongated end member 558 is disposed between and connected to the elongated side members 540, 546 near the second ends 544, 550 thereof such that the first end 560 of the elongated end member 558 is connected to the elongated side member 540 and the second end 562 of the elongated end member 558 is connected to the elongated side member 546. Thus, the connection of the elongated side members 540, 546 and the elongated end members 552, 558 provides the mattress frame 514 with a substantially rectangularly shaped configuration substantially as shown.

Referring now to FIGS. 6 and 10, the tiltable bed assembly 510 further comprises the elevating assembly 150 for pivoting the mattress frame 514 to the desired angular disposition. The elevating assembly 150 is disposed between and connected to the main frame 512 and the mattress frame 514 such that one end of the mattress frame 514 can be selectively elevated to provide the mattress frame 514 with a desired angular disposition relative to the main frame 512.

The elevating assembly 150 comprises the track member 152, the pair of support members 154, 156 and the power assembly 15.. The track member 152 is a substantially U-shaped member having a first end 160 and an opposed second end 162. The first end 160 of the track member 152 is connected to the elongated member 520 of the main frame 512 and the second end 162 thereof is connected to the elongated member 524 of the main frame 512 substantially as shown. That is, the track member 152 is connected near the end portion of the main frame 512 so that the elongated axis of the track member 152 is substantially normal to the elongated axis of the elongated members 520 and 524; and the track member 150 is positioned below the end portion of the mattress frame 514 which is to be selectively movable to an elevated position.

The support member 154 is provided with the lower end 164, the medial portion 163 and the opposing upper end 166; and the support member 156 is provided with the lower end 170, the medial portion 172 and the opposing upper end 174. The lower end 164 of the support member 154 is slideably supported by one end portion of the track member 152; and the opposing upper end 168 of the support member 154 is pivotally attached to the elongated end member 552 of the mattress frame 514 near the first end 554 thereof. Similarly, the lower end 170 of the support member 156 is slideably supported by an opposite end portion of the track member 152; and the opposing upper end 174 of the support member 156 is pivotally attached to the elongated end member 552 of the mattress frame 514 near the opposed second end 556 thereof.

The power assembly 158 is operably connected to the lower ends 164, 170 of the support members 154, 156, respectively, so that the lower ends 164, 170 of the support member 154, 156 can be simultaneously and synchronizingly moved either toward each other or away from each other to alter the angular portion of the supported end of the mattress frame 514 relative to the main frame 512.

The power assembly 158 comprises linkage members 176, 178 and the rheostat controlled reversible motor 180. One end 182 of the linkage member 176 is operably connected to a drive shaft (not shown) of the motor 180; and an opposed second end portion 184 of the linkage member 176 is provided with right-handed threads. Similarly, one end 186 of the linkage member 178 is operably connected to the drive shaft of the motor 180; and an opposed second end portion 188 is provided with left-handed threads.

As more clearly shown in FIG. 6, the elevating assembly 150 further comprises traveler members 190, 192. The traveler members 190, 192, which are provided with threaded bores (not shown) extending therethrough are pivotally connected to the first support members 154, 156 substantially as shown. The threaded bore of the traveler member 190 threadingly receives the right-handed threads on the opposed second end 184 of the linkage member 176; whereas the threaded bore of the traveler member 192 threadingly receives the eft-handed threads on the opposed second end portion 188 of the linkage member 178. Upon actuation the motor 180 causes the linkage members 176, 178 to rotate in response to the directional rotation of the drive shaft of the motor 180. Thus, the threaded end portions 184, 188 of the linkage members 176, 178 serve as gear drive assemblies for the traveler members 190, 192.

To stabilize the support members 154, 156, the power assembly 158 further comprises stabilizing struts 194 having a first end 196 and an opposed second end 198, and stabilizing struts 200 having a first end 202 and an opposed second end 204. The first end 196 of the struts 194 are connected to one end of the track member 150 such that the struts 194 are spatially disposed and adapted to receive the support member 154 therebetween; and the opposed second ends 198 thereof are pivotally connected to the medial portion 166 of the support member 154. Similarly, the first ends of the struts 200 are connected to the opposed end of the track 150 such that the struts 200 are spatially disposed and adapted to receive the support member 156 therebetween; and the opposed second ends 204 thereof are pivotally connected to the medial portion 172 of the support member 156.

To enhance the movement of the support members 154, 156 along the track member 152, the elevating assembly 150 further comprises wheels 206 connected for rotational movement to a pivot member 208, and wheels 210 connected for rotational movement to a pivot member 212. The pivot member 208 is connected to the lower end 164 of the support member 154 so as to pivotally support the traveler member 190. Similarly, the pivot member 212 is connected to the lower end 170 of the support member 156 so as to pivotally support the traveler member 192.

In order to provide versatility to the elevating assembly 150, that is, to construct the elevating assembly so that the overall length can be varied to accommodate varying widths of bed frames, the track member 152 can be fabricated of sections which are secured together by a plurality of bolts and nuts. In such instance, coupler members (not shown) can be used to alter the effective length of linkage members 176 and 178. Further, the construction of the tiltable bed frame assembly 510 enables one to attach to the main frame 512 a headboard and footboard of a conventional bedroom suit.

From the above description it is clear that the improved tiltable bed assemblies 10, 310 and 510 are well adapted to carry out the objects and to attain the ends and advantages mentioned herein as well as those inherent in the invention. While presently preferred embodiments of the invention have been described for purposes of this disclosure it will be understood that numerous changes may be made which will readily suggest themselves to those skilled in the art and which are accomplished within the spirit of the invention disclosed and as defined in the appended claims.

What is claimed is:

1. An improved tiltable bed frame assembly comprising:

a main frame comprising:

a plurality of elongated members rigidly interconnected to provide a substantially rectangular shaped main frame having opposed, spatially disposed sides; and a plurality of post members substantially normally disposed relative to the elongated axis of the opposed sides of the main frame, one of the post members being a foot post member positioned near one end of each of the sides of the main frame, one of the post members being a head post member positioned near an opposed end of each of the sides of the main frame, and one post member being a center post member positioned intermediate the foot post and the head post members, the foot post members having a length less than the length of the center post members;

a mattress frame pivotally supported by the center post members such that the mattress frame can be selectively pivoted to an angular position relative to the main frame, the mattress frame comprising:

a plurality of elongated members rigidly interconnected to provide a substantially rectangular shaped mattress frame having opposed, spatially disposed sides; and a plurality of leg members substantially normally disposed relative to the elongated axis of the opposed sides of the mattress frame, one of the leg members being positioned near one end of each side of the mattress frame so as to be aligned with one of the foot post members of the main frame, one of the leg members being positioned near an opposed end of each side of the mattress frame so as to be aligned with one of the head post members of the main frame; and linkage means for connecting the leg members supported by sides of the mattress frame to the foot post members and the head post members supported by the sides of the main frame such that leg members of the mattress frame can be telescopically moved relative to the foot and head post members of the main frame during pivotal movements of the mattress frame relative to the main frame.

2. The improved tiltable bed frame assembly of claim 1 further comprising:

locking means selectively engaging the linkage means for securing the leg members of the mattress frame to the foot post members and the head post members of the main frame in a stationary position and thereby maintain the mattress frame in the desired angular position relative to the main frame.

3. The improved tiltable bed frame assembly of claim 1 wherein the post members of the main frame are tubular member adapted to telescopically receive the aligned leg members of the mattress frame, and wherein said linkage means comprises a pair of linkage assemblies, one of the linkage assemblies supported by the elongated member defining one side of the main frame, the other of the linkage assemblies supported by the elongated member defining the other side of the main frame, each of the linkage assemblies comprising:

a linkage member having a first end portion, a medial portion and an opposed second end portion, the first end portion connected to the leg member of the mattress frame telescopically disposed in the foot post member of the main frame, the second end portion connected to the leg member of the mattress frame telescopically disposed in the head post member of the main frame such that the medial portion of the linkage member extends through an elongated channel defined by the elongated member forming the side of the main frame;

a plurality of first guide rollers supported by the side of the main frame such that one of the first guide rollers is disposed substantially adjacent the intersection of the foot post member and the side of the main frame and another of the first guide rollers is disposed substantially adjacent the intersection of the head post member and the side of the main frame, the first guide rollers adapted to support the medial portion of the linkage member thereon; and a plurality of second guide rollers, one of the second guide rollers rotatably supported on one end of the leg member of the mattress frame to stabilize the leg member as same is telescopically moved within the foot post member of the main frame, another of the second guide rollers rotatably supported on one end of another of the leg members of the mattress frame to stabilize the leg member as same is telescopically moved within the head post member of the main frame.

4. The improved tiltable bed assembly of claim 3 further comprising:

locking means selectively engaging the leg members of the mattress frame telescopically positioned within the foot post member and the head post of the main frame for securing the leg members of the mattress frame in a stationary position within the foot post members and thereby stabilizing the mattress frame in a desired angular position relative to the main frame.

5. The improved tiltable bed assembly of claim 3 further comprising:

elevating means for pivoting the mattress frame to a selected angular disposition, the elevating means comprising:

a track member having a first end portion, a medial portion, and an opposed second end portion, the first end portion connected to one side of the main frame and the opposed second end portion connected to the other side of the main frame such that the track member is substantially normally disposed to the elongated axis of the sides of the main frame and positioned near one end of the main frame;

a first support member having a lower end slideably supported by the track member, a medial portion, and an opposed upper end pivotally attached to the mattress frame near one end thereof; and power means for moving the lower end of the first support member along the track member so that the end of the mattress frame is selectively elevated to pivot the mattress frame on the main frame.

6. The improved tiltable bed frame assembly of claim 5 wherein the elevating means further comprises traveler means pivotally supported on the first support member; and wherein the power means comprises:

a reversible motor having a drive shaft; and a linkage assembly having a first end and a second end portion, the first end of the linkage assembly operably connected to the drive shaft such that upon actuation of the motor selective rotational movement is imparted to the linkage assembly, the second end portion of the linkage means such that the first support member is moved relative to the track member in response to the rotational movement of the linkage assembly.

7. The improved tiltable bed assembly of claim 6 further comprising:

first stabilizing struts having a first end and an opposed second end, the first end of the first struts being connected to the track member such that the first struts are spatially disposed and adapted to receive the first support member therebetween, the opposed second ends of the first stabilizing struts being connected to the medial portion of the first support member.

8. The improved tiltable bed frame assembly of claim 7 wherein the track member is characterized as having a first end portion and an opposed second end portion, and wherein the elevating means further comprises:

a second support member having a lower end slideably supported by the track member, the second support member having an opposed upper end pivotally attached to the mattress frame so as to be substantially parallel to the first support member, the first support member adapted to travel a distance along the first end portion of the track member and the second support member adapted to travel a corresponding distance along the second end portion of the track member.

9. The improved tiltable bed frame assembly of claim 8 wherein the traveler means comprises a first traveler member having a threaded bore extending therethrough and a second traveler member having a threaded bore extending therethrough, the first traveler member pivotally supported by the first support member of the elevating means, the second traveler member pivotally supported by the second support member of the elevating means; and wherein the linkage assembly of the power means comprises:

a first linkage member having a first end and a threaded opposed second end portion, the first end operably connected to the drive shaft of the reversible motor and the threaded opposed second end portion matingly engaging the threaded bore of the first traveler member; and a second linkage member having a first end and a threaded opposed second end portion, the first portion of the second linkage member operably connected to the drive shaft of the reversible motor, the threaded opposed second end portion of the second linkage member threadably engaging the threaded bore of the second traveler member such that the first and second support members are selectively moved in response to the rotational movement of the first and second linkage members.

10. The improved tiltable bed frame assembly of claim 9 wherein the elevating means further comprises wheel means connected to the lower end portion of the first and second support members for enhancing movement of the first and second support members of the elevating means along the track member.

11. The improved tiltable bed frame assembly of claim 1 wherein the elongated members forming the opposed sides of the main frame are channel members defining an elongated channel extending therethrough, each of the channel members having a first slot formed in one end thereof and a second slot formed in an opposed second end thereof such that the first and second slots are aligned with the leg members of the mattress frame, the linkage means comprising a pair of linkage assemblies, one of the linkage assemblies supported by one of the channel members defining one side of the main frame, the other of the linkage assemblies supported by the channel members defining the other side of the main frame, each of the linkage assemblies comprising:

a linkage member having a first end portion and an opposed second end portion, the linkage member positionable within the channel of the channel members such that the first end portion extends into the first slot and the opposed second end portion extends into the second slot;

a first support plate extending upwardly from the channel member so as to be disposed against one side of the first slot formed in the channel member;

a first cam follower pivotally connected at a first pivot position to the first support plate to permit selective pivotal movement of the first cam follower in the first slot, the first cam follower pivotally connected at a second pivot position to the first end of the linkage member and at a third pivot position to a distal end of one of the legs of the mattress frame, the first, second and third pivot position of the first cam follower defining an equilateral triangular pivot arrangement;

a second support plate extending upwardly from the channel member so as to be disposed adjacent one side of the second slot formed in the channel member; and a second cam follower pivotally connected at a first position to the second support plate to permit selective pivotal movement of the second cam follower in the second slot, the second cam follower pivotally connected at a second pivot position to the opposed second end of the linkage member, and at a third pivot position to a distal end of one of the legs of the mattress frame, the first, second and third pivot positions defining an equilateral triangular pivot arrangement such that when the first and second cam followers are selectively rotated the linkage assembly is maintained in a horizontally disposed position within the channel of the channel member for selective movement in one of a to or fro direction in response to the pivotal movement of the first and second cam followers and pivotal movement of the mattress frame relative to the main frame.

12. The improved tiltable bed frame assembly of claim 11 further comprising:

locking means for selectively engaging the first and second cam followers for securing the first and second cam followers in a stationary position and thereby secure the mattress frame in the desired position relative to the main frame.

13. The improved tiltable bed frame assembly of claim 12 wherein a lower portion of the channel member defining the first slot is provided with a strut receiving opening in an outwardmost end portion of the first slot and the lower portion of the channel member defining the second slot is provided with a strut receiving opening in an outwardmost end portion of the second slot, the first and second cam followers each having an arcuate shaped cam surface formed along a side portion opposite the pivotal attachment of the first and second cam followers to the first and second support plates, and wherein the locking means further comprises:

a first cam member pivotally connected to the channel member, the first cam member having an arcuate shaped surface adapted to tangentially interface with the arcuate shaped cam surface of the first cam follower and lockingly engaging the first cam follower;

a first strut having a first end and an opposed second end, the first end thereof connected to the first cam member such that the second end extends from the channel member through the strut receiving opening;

first biasing means for biasing the first cam member in a first cam follower engaging position;

a second cam member pivotally connected to the channel member, the second cam member having an arcuate shaped surface adapted to tangentially interface with the arcuate shaped cam surface of the second cam follower and lockingly engage the second cam follower;

a second strut having a first end and an opposed second end, the first end thereof connected to the second cam member such that the second end extends from the channel member through the strut receiving opening; and second biasing means for biasing the second cam member in a second cam follower engaging position.

* * * * *

UNITED STATES PATENT AND TRADEMARK OFFICE

CERTIFICATE OF CORRECTION

PATENT NO. : 4,856,129

DATED : August 15, 1989

INVENTOR(S) : Wilbur T. Butler

It is certified that error appears in the above-identified patent and that said Letters Patent is hereby corrected as shown below:

Column 1, line 43, delete "4,715,073" and substitute --4.715,037-- therefor;

Column 12, line 17, delete "therethrough A" and substitute --therethrough. A-- therefor;

Column 13, line 48, delete "362 The" and substitute --362. The-- therefor;

Column 16, line 3, delete "15.." and substitute --158.-- therefor; and

Column 16, line 62, delete "eft-handed" and substitute --left-handed-- therefor.

Signed and Sealed this

Thirteenth Day of August, 1991

*Attest:*

HARRY F. MANBECK, JR.

*Attesting Officer*

*Commissioner of Patents and Trademarks*